US006059029A

United States Patent [19]

Goode

[11] Patent Number: 6,059,029

[45] Date of Patent: May 9, 2000

[54] COILED TUBING INJECTOR

[75] Inventor: John E. Goode, Arlington, Tex.

[73] Assignee: Hydra Rig, Inc., Ft. Worth, Tex.

[21] Appl. No.: 09/070,592

[22] Filed: Apr. 30, 1998

Related U.S. Application Data

[60] Provisional application No. 60/045,366, May 2, 1997.

[51] Int. Cl.[7] ..... E21B 33/00

[52] U.S. Cl. ..... 166/77.3; 74/665 GA; 74/665 N

[58] Field of Search ..... 166/77.3, 77.2; 74/665 GA, 665 N; 226/172, 173

[56] References Cited

U.S. PATENT DOCUMENTS

| | | | |
|---|---|---|---|
| 3,401,749 | 9/1968 | Daniel . | |
| 3,667,554 | 6/1972 | Smitherman . | |
| 3,822,559 | 7/1974 | Mathews, Jr. et al. . | |
| 3,824,875 | 7/1974 | Willert et al. | 74/665 GA |
| 3,827,487 | 8/1974 | Jackson et al. . | |
| 3,866,882 | 2/1975 | Willm et al. . | |
| 4,655,291 | 4/1987 | Cox | 166/385 |
| 4,899,620 | 2/1990 | Schiffer | 74/665 N |
| 5,188,174 | 2/1993 | Anderson, Jr. et al. | 166/77.3 |
| 5,309,990 | 5/1994 | Lance . | |
| 5,533,659 | 7/1996 | Benedict et al. . | |
| 5,918,671 | 7/1999 | Bridges et al. | 166/77.3 |

FOREIGN PATENT DOCUMENTS

| | | |
|---|---|---|
| 953644 | 9/1974 | Canada . |
| 1056808 | 6/1979 | Canada . |
| 1096850 | 3/1981 | Canada . |
| 2029478A | 3/1980 | United Kingdom . |

*Primary Examiner*—George Suchfield
*Attorney, Agent, or Firm*—Marc A. Hubbard; Munsch Hardt Kopf & Harr, P.C.

[57] ABSTRACT

A coiled tubing injector has a transmission with reduction gear trains having two rotary power outputs for driving each of the injector's two chains, and one or more rotary power inputs located on the same side of the transmission as the rotary drive outputs.

17 Claims, 7 Drawing Sheets

COILED TUBING INJECTOR

This application claims the benefit of U.S. provisional patent application Ser. No. 60/045,366, filed May 2, 1997, which application is incorporated herein by reference.

FIELD OF THE INVENTION

The invention relates generally to coiled tubing injectors for handling a continuous length of tubing or pipe for insertion into or removal from a well bore, and for drilling well bores.

BACKGROUND OF THE INVENTION

Continuous, reeled pipe, generally known within the energy industry as coiled tubing, has been used for many years. It is much faster to run into and out of a well bore than conventional, jointed, straight pipe.

Coiled tubing is run in and out of well bores using what are well known in the energy industry as coiled tubing injectors. The name derives from the fact that, in well bores, the tubing must be literally forced or "injected" into the well through a sliding seal to overcome the well pressure until the weight of the tubing exceeds the force produced by the pressure acting against the cross-sectional area of the tubing. However, once the weight of the tubing overcomes the pressure, it must be supported by the injector. The process is reversed as the tubing is removed from the well.

The only method by which a continuous length of tubing can be either forced against pressure into the well, or supported while hanging in the well bore or being lowered or raised is by continuously gripping a length of the tubing just before it enters the well bore. This is achieved by arranging two continuous chain loops on opposite sides of the tubing, in an opposing relationship. The continuous chains carry a series of gripper shoes which are pressed against opposite sides of the tubing and grip the tubing. Each chain is stretched between a drive sprocket and an idler sprocket. At least one of the two drive sprockets is driven by a motor to turn one of the continuous chains to supply injection or pulling force. The other drive sprocket may also be driven, typically by a second motor, to drive the second chain in order to provide extra power.

Coiled tubing has traditionally been used primarily for circulating fluids into the well and other work over operations, rather than drilling, because of its relatively small diameter and because it was not strong enough, especially for deep drilling. In recent years, however coiled tubing has been increasingly used to drill well bores. For drilling, a turbine motor is suspended at the end of the tubing and is driven by mud or drilling fluid pumped down the tubing. Coiled tubing has also been used as permanent tubing in production wells. These new uses of coiled tubing have been made possible by larger, stronger coiled tubing.

To handle the longer and heavier tubing, used in drilling, an injector must be capable of carrying much greater loads. Drilling sometimes progresses very slowly. Therefore, in addition to running the pipe into and out of the hole rates measured in tens or hundreds of feet per minute, the injector must also be capable of advancing the pipe at rates measured in inches per hour. Because of the required control, power for driving an injector used for drilling is usually provided by a high speed, low torque, hydraulic motor, rather than a low speed, high torque hydraulic motor. Low speed, high torque motors are conventionally used on injectors. A high speed, low torque motor must be coupled to the injector through a transmission with reduction gearing.

As shown, for example, in FIG. 1, a prior art coiled tubing injector 101 (shown in section) has a conventional configuration of two continuous chains 103 and 105, each looped around one of two upper sprockets 107 and 109, respectively, and on one of two lower sprockets (not visible). Sprockets 107 and 109 are mounted on shafts 111 and 113, respectively, and are keyed to the sprockets through splines 114. Each shaft is journalled on frame 115. Each chain carries a plurality of grippers 117. As the loops of the chains turn, grippers 117 are pressed against opposite sides of continuous tubing 119. A high speed, low torque hydraulic motor 121 is coupled to shaft 111 to supply power to turn chain 103 through a brake 123 and planetary gear box 125. Similarly, high speed, low torque hydraulic motor 127 is coupled to shaft 113 through brake 129 and planetary gear box 131 to drive chain 105. The axis of each motor and planetary gear box is aligned with the axis of the shaft they turn. Because of the diameter of the planetary gear boxes and motors, a motor and planetary gear box must be mounted on opposite sides of the chains in order to synchronize movement of the respective chains, intermeshing timing gears 135 and 137 are mounted on shafts 111 and 113. The timing gears are capable of transmitting only as much power as is required to maintain timing between the chains. As is evident from the illustration, as the sizes of the motors and gearing increase to handle larger loads, so too will the depth of the coiled tubing injector, as measured perpendicularly with respect to the plane of rotation 139 of the sprockets and chains, in directions indicated by arrows 141*a* and 141*b*.

SUMMARY OF THE INVENTION

The invention is directed to coiled tubing injectors, particularly those used for drilling well bores, having an improved drive configuration for accommodating a larger, more powerful motor and speed-reducing transmission, as well one or more additional motors, without a corresponding increase in depth of the injector.

In a conventional configuration, a larger motor will increase the depth of the injector, making transportation and set up more difficult. Most drilling rigs were made to drill with jointed, straight pipe. They have long, narrow openings which may not be, in many cases large enough to accommodate passage of coiled tubing injectors of conventional configuration, as shown in FIG. 1, with motors powerful enough for drilling. In order to install a coiled tubing injector of conventional configuration, either a larger opening would have to be cut in a drilling rig and/or the injector dissembled in part and then reassembled inside the rig. Reassembling a large injector on a drilling rig is time consuming, often requiring special tools, and is generally undesirable.

Because of its narrower profile or depth, a coiled tubing injector according to the present invention may be more readily inserted through a standard opening in a conventional drilling rig. A coiled tubing injector according to the present configuration need not have separate timing gears. Furthermore, it does not use planetary gear transmissions. Planetary gear transmissions which are the most frequently used types of transmissions on coiled tubing injectors, tend to become overheated due to their relatively compact design and small exterior surface area. Either a larger than necessary planetary gear transmission or an oil cooling system must be employed to avoid overheating when running at high power levels, either of which increases the cost of the injector. Since a transmission in accordance with thc present invention has a relatively larger surface area, it will have a higher thermal horsepower rating, thereby allowing it to transmit greater power. These and other aspects and advantages of the invention are described below in connection with a preferred embodiment of the invention illustrated in the accompanying drawings.

DETAILED DESCRIPTION

In the following description, like numbers refer to like elements.

Figure 1:
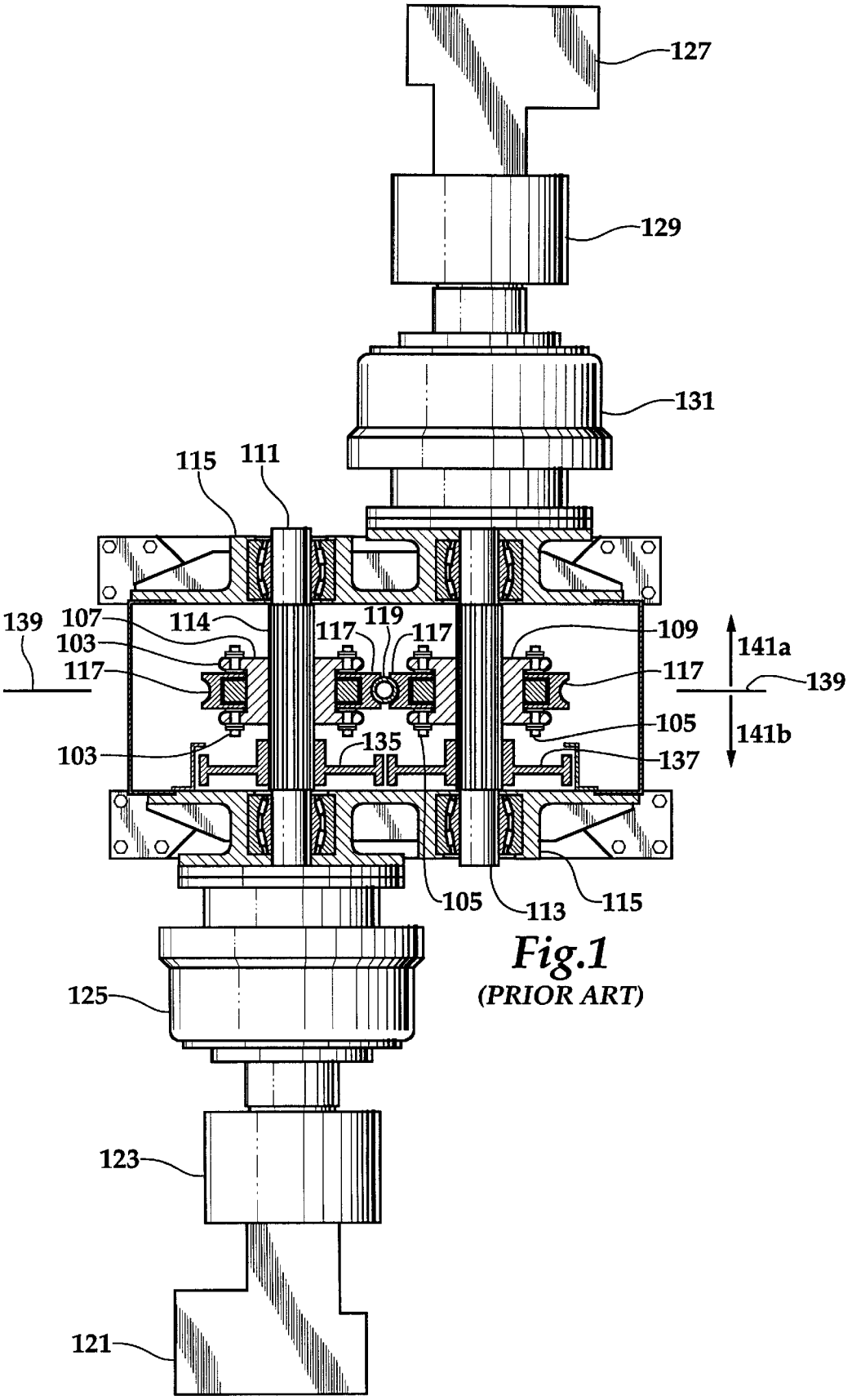
Fig.1 (PRIOR ART)
FIG. 1 is a cross-sectional view of a prior art coiled tubing injector.
Figure 2:
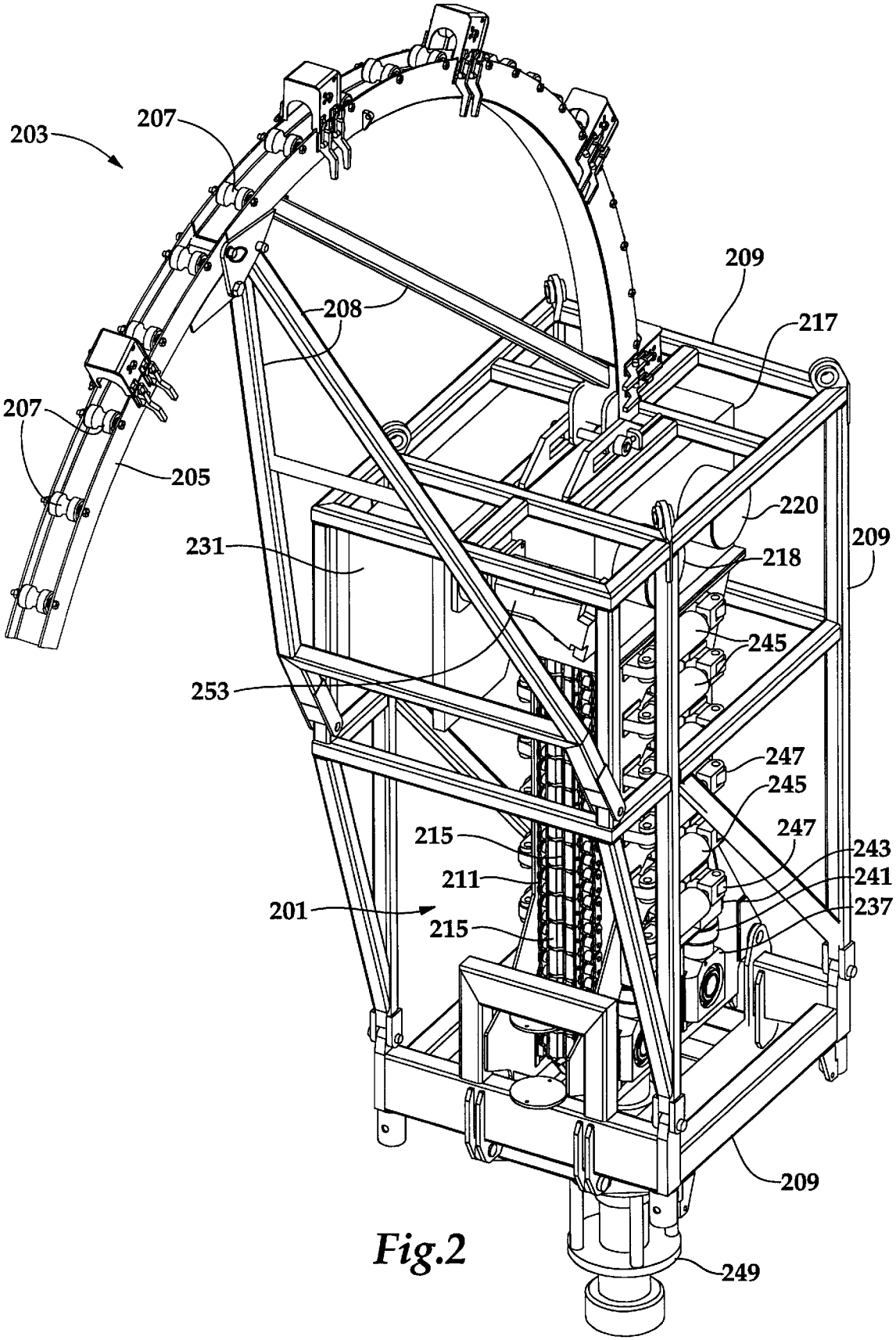
FIG. 2 is an isometric view of a coiled tubing injector according to the present invention.

Referring to FIG. 2, coiled tubing (not shown) is transported into the top of coiled tubing injector 201 from a reel (not shown) on a "goose-neck" support 203. The goose-neck support includes a frame 205 supporting a plurality of rollers 207. Bracing 208 extending from cage 209 positions the goose-neck support 203 in proper relation to the injector 201. The cage 209 also supports the injector 201 for handling and providing lateral support. Legs (not shown) may also be attached to the corners of the bottom of the cage 201 to stand the injector above a well head (not shown).

Figure 3:
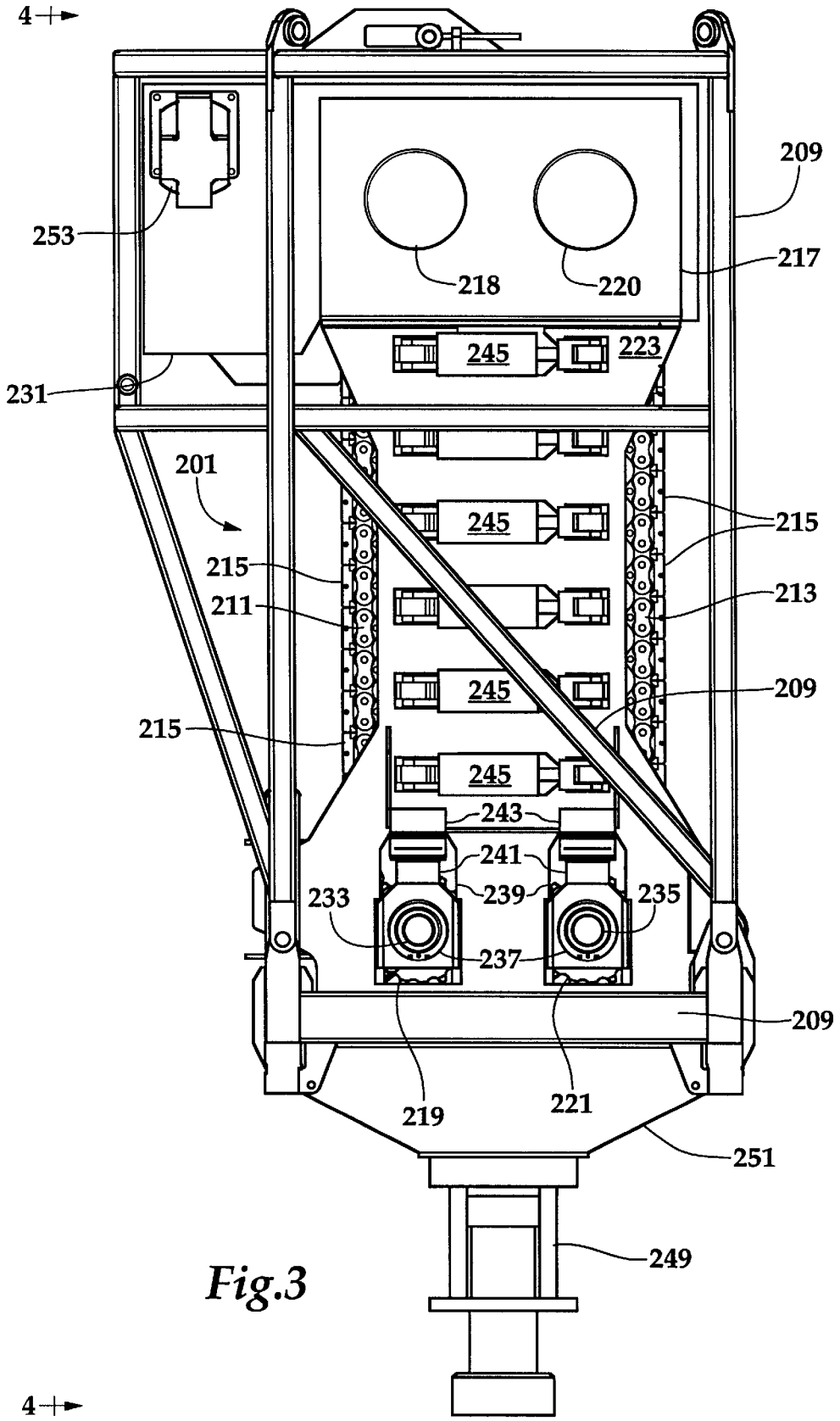
FIG. 3 is a front elevational view of the coiled tubing injector shown in FIG. 2.
Figure 4:
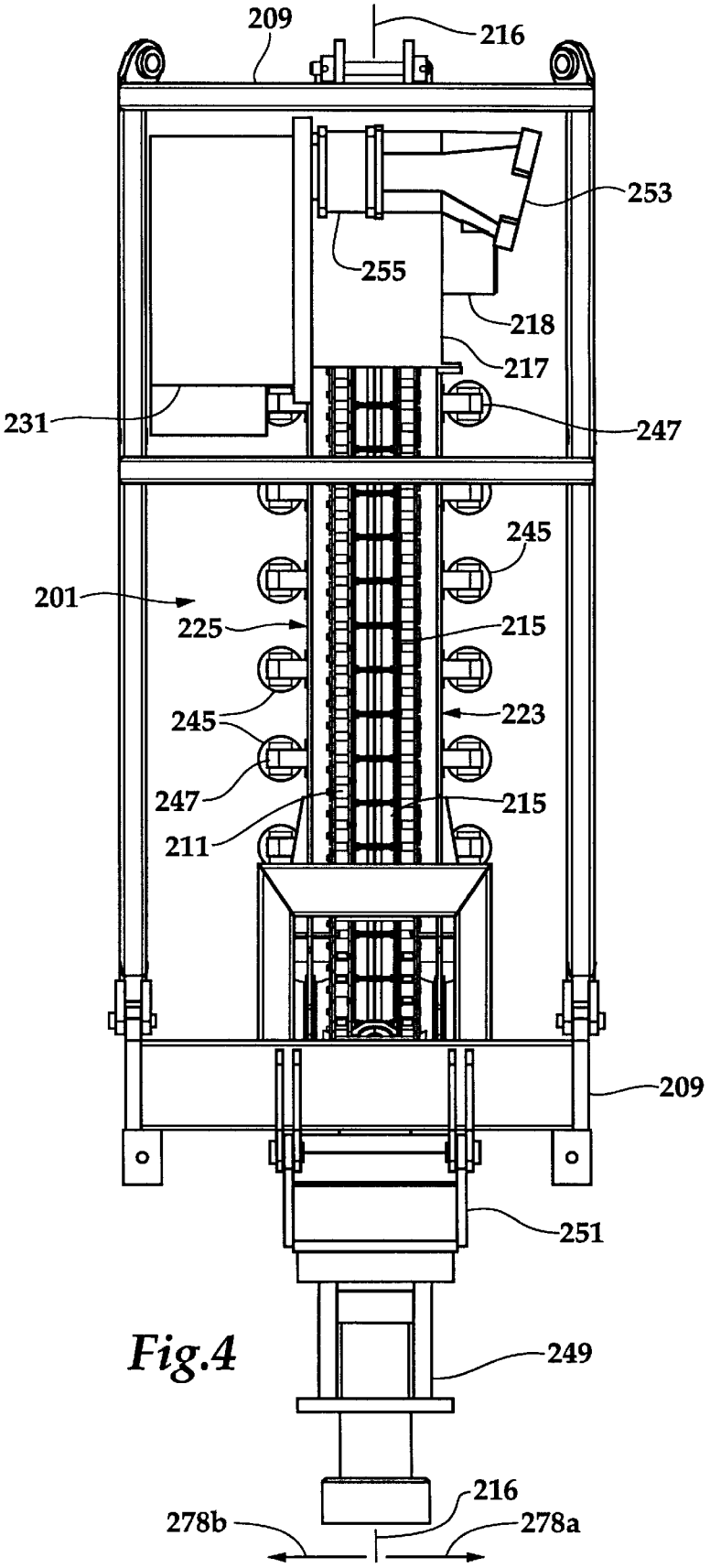
FIG. 4 is a left side elevational view of the coiled tubing injector shown in FIGS. 2 and 3.

Referring now to FIGS. 2, 3 and 4, injector 201 includes two, continuous loop drive chains generally designated by reference numbers 211 and 213. Connected to each drive chain is a plurality of grippers 215. The chains 211 and 213 are arranged in a conventional, opposing relationship, rotating in a substantially common plane 216. Each drive chain is mounted on an upper drive sprocket and a lower drive sprocket. The upper drive sprockets are mounted within drive housing 217 and are not visible in these views. Bearing housing 218 and 220 each accommodates a bearing for one end of the shaft of each upper drive sprocket. The other ends of the drive sprocket shafts are supported by bearing assemblies mounted to the opposite side of drive housing 217. Drive chain 211 is mounted on lower drive sprocket 219, and drive chain 213 is mounted on lower drive sprocket 221.

A box-shaped frame is formed from two, parallel plates 223 and 225, separated by side plate 227 and a second side plate parallel to side plate 227 but not visible in these views. This frame supports the drive housing 217 and transmission gear box 231 at its upper end, and the lower drive sprockets at its lower end.

The lower drive sprockets 219 and 221 are connected to shafts 233 and 235, respectively. Each shaft extends between the front and back panels of the frame. The end of each shaft is journalled within a carrier 237. Each carrier is mounted so that it may slide vertically within one of four elongated slots 239 defined in the back plate 225 and front plate 223 of the frame. A hydraulic cylinder 241 is inserted between the top of each carrier and a block 243 connected to the frame at the top of each elongated slot. Each of cylinder 241 applies a force to a carrier 237 to push down the lower drive sprockets 219 and 221 with respect to the frame (and thus also the upper drive sprockets since they are mounted in fixed relationship to the frame) and thereby tension the drive chains. The frame thus carries the tensioning load.

Although not visible, coiled tubing injector 201 includes two skates, one for each drive chain, for forcing the grippers 215 toward each other, against the coiled tubing, as they enter the area between the two drive chains through which the coiled tubing passes. Example of such skates are shown U.S. Pat. No. 5,309,990 and are well known in the art. A plurality of hydraulic cylinders 245 are used to pull together the skates and maintain uniform gripping pressure against coiled tubing along the length of the skates. Each cylinder 245 is connected at each end through a clevis and pin to an eyelet 247 of a bar extending behind one of the skates and terminating in another eyelet connected to another piston on the opposite side of the injector. At a bottom of the injector, a stripper 249 carried by a stripper adapter 251, connects the injector to a well head.

Power for driving the injector is provided by a high speed, low torque hydraulic motor 253 coupled to the drive box 231 through brake 255. The hydraulic motor is supplied with a pressurized hydraulic fluid in a conventional manner.

Figure 5:
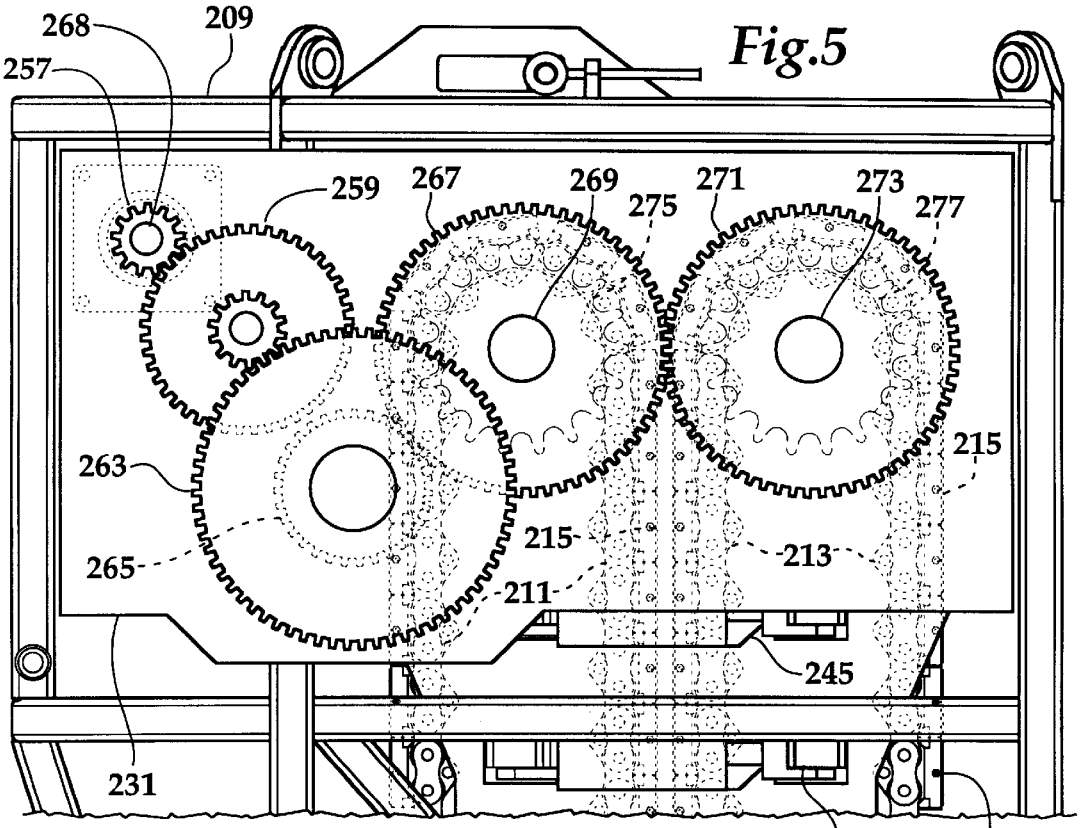
FIG. 5 is a partial front view of the coiled tubing injector shown in FIGS. 2–4 with a front wall of a transmission gear box removed to reveal components of a transmission.
Figure 6:
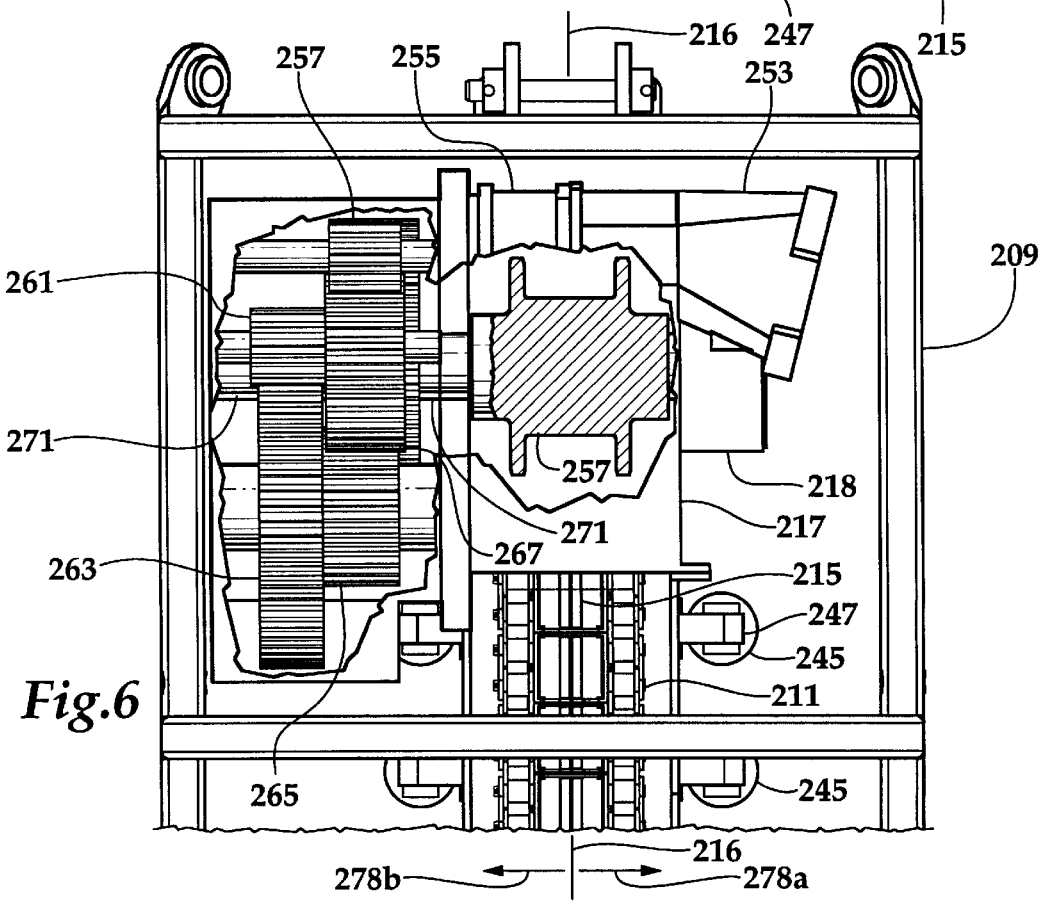
FIG. 6 is a partial side view of the coiled tubing injector shown in FIGS. 2–5 with a portion of the transmission's side wall, a motor and a side wall of a drive housing broken away.

Referring now to FIGS. 5 and 6, rotationally mounted within transmission gear box 231 is a train of speed-reduction, spur gears 257, 259, 261, 263, 265 and 267. Input shaft 268, which is connected to spur gear 257, is also connected to the output shaft of motor 253 (which is shown only in FIG. 6) through brake 255 (also shown only in FIG. 6). The speed-reduction gear train amplifies the torque on, and reduces the rotational velocity of, output shafts 269 and 273. The gear box protects the gear train from environmental influences and holds lubricants for the gear trains. The number and diameter of the various spur gears used in the gear chain depend on the hydraulic motor and a number of other factors. The invention is not limited to any precise number of gears. The gear train turns primary output gear 267, which rotates output shaft 269. Primary output gear 267 also transmits power to a second primary output gear 271, of equal diameter, which rotates output shaft 273 at the same speed and in synchronization with output shaft 269. Thus, the transmission provides two, low speed, high torque, synchronous rotational outputs from a single input. Output shafts 269 and 273 are connected to, and turn, sprockets 275 and 277. Drive chain 211 loops around and is driven by upper drive sprocket 275. Drive chain 213 loops around and is driven by upper drive sprocket 277.

As can be best seen in FIGS. 4 and 6, this transmission is not deep along the directions perpendicular to plane 216 indicated by arrows 278*a* and 278*b*. Its narrow depth, accomplished by extending the reduction gear train in a plane substantially parallel to the plane 216, complements the narrow profile of the drive chains 211 and 213. Furthermore, by utilizing a spur driven, reduction gearing rather than more conventional planetary gearing, not only is a narrower injector profile achieved, but the motor may be located laterally to one side of the drive chains 211 and 213. The hydraulic motor and brake thus may be placed on the same side of the transmission as the drive chains, extending through the plane 216 defined of the revolution of the drive chains. Larger and/or additional motors can be accommodated around the drive chains by extending or adding another gear train generally within the same plane as the other gears in the transmission, which plane is parallel to plane 216, without substantially increasing the depth of the profile of the injector.

Figure 7:
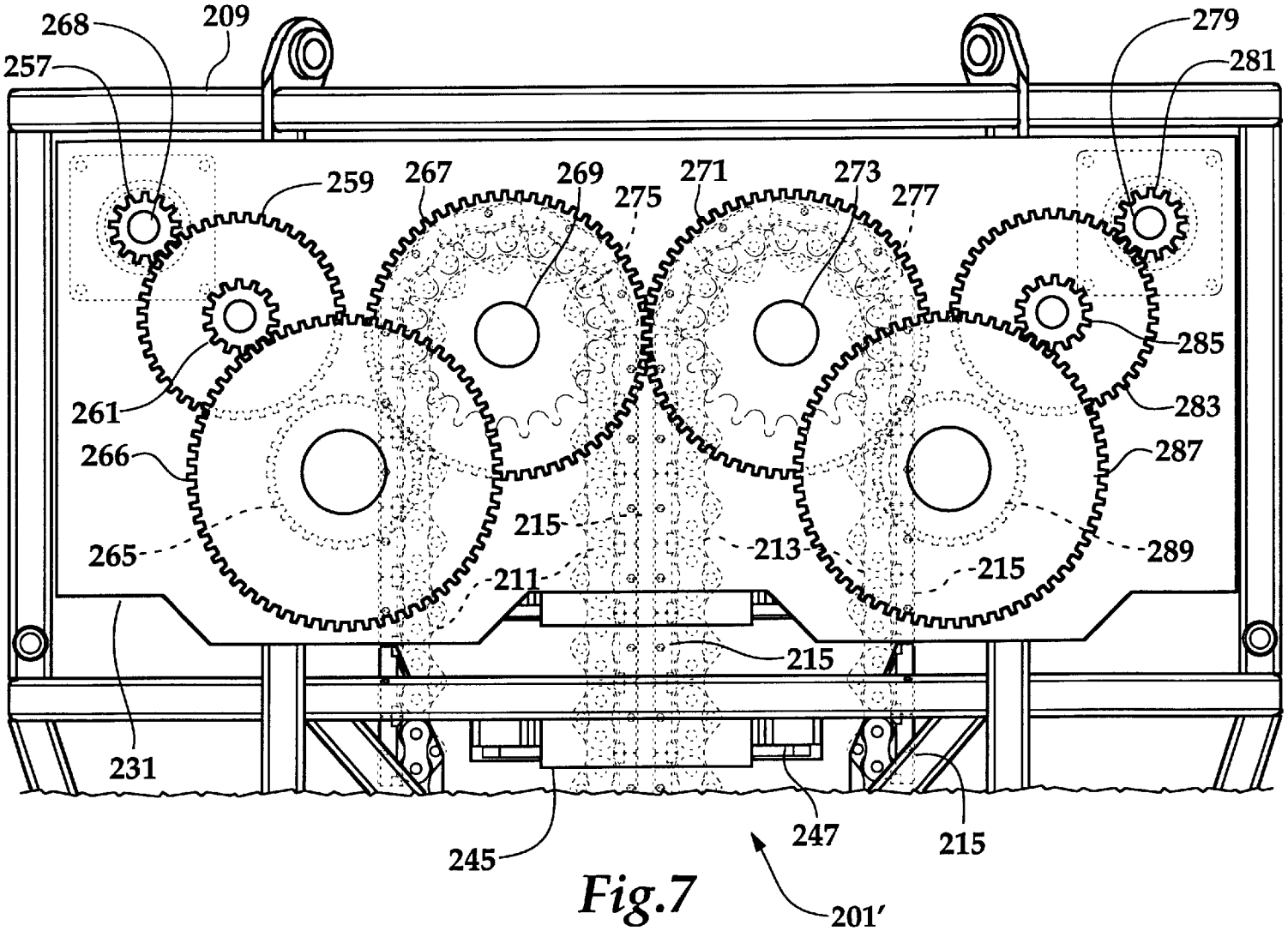
FIG. 7 is a partial view of the front of an embodiment of a coiled tubing injector according to the present invention, having a dual input transmission gear box for two motors, with a front panel of the gear box removed.
Figure 8:
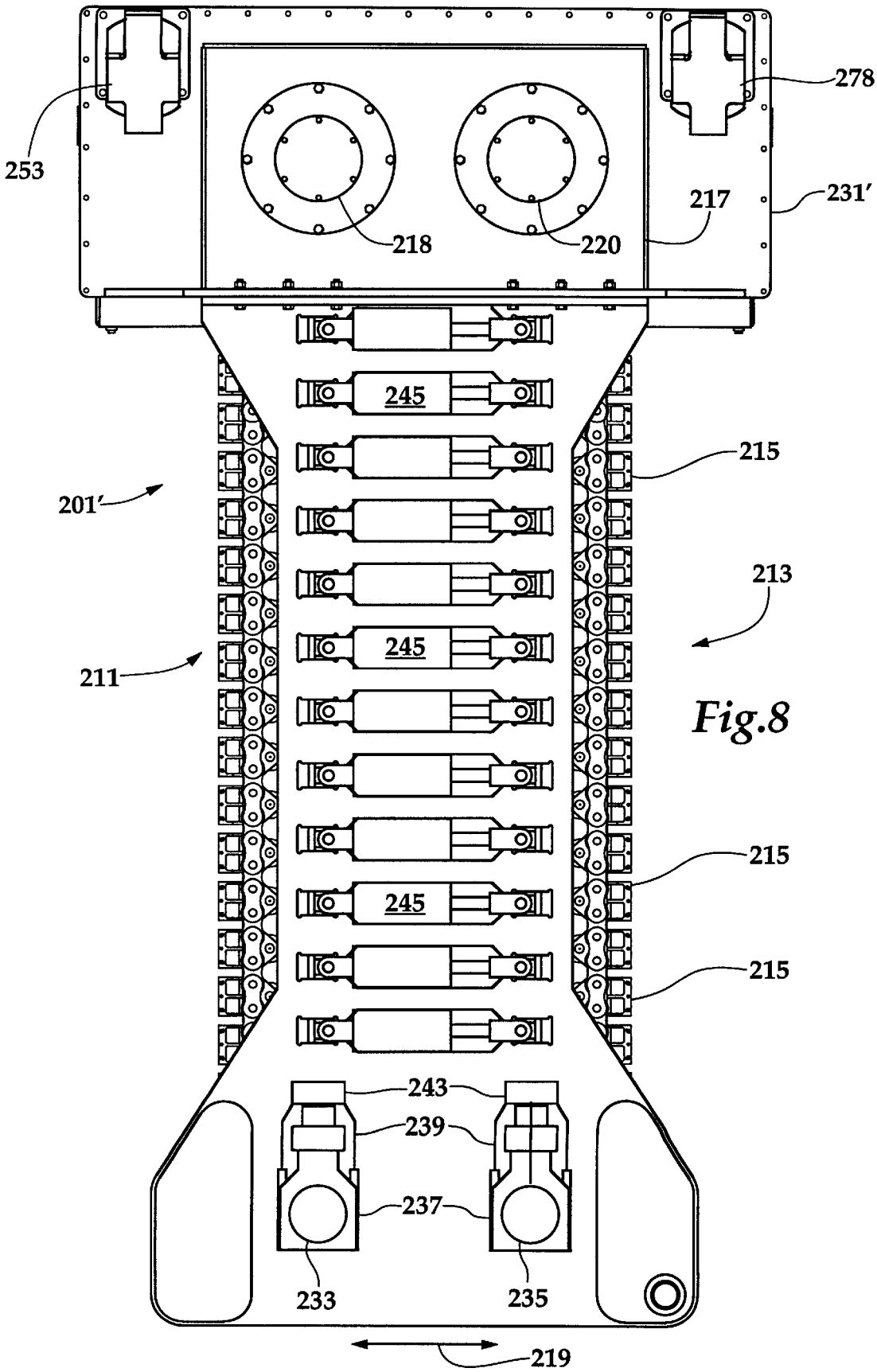
FIG. 8 is a front elevational view of the coiled tubing injector of FIG. 7.

As shown in FIGS. 7 and 8 the drive configuration illustrated in FIGS. 2–6 easily accommodates a modified transmission gear box 231' that, as compared with gear box 231 of FIGS. 2–6, extends laterally, generally parallel to the plane 216 in which drive chains 211 and 213 rotate, in order to accommodate a second power input from a second hydraulic motor 278. This second power input doubles the power delivered to the injector. The second hydraulic motor is connected to input shaft 279. The input shaft turns a second speed reduction, spur-gear drive train comprised of spur gears 281, 283, 285, 287 and 289. Spur Gear 289 turns second primary output gear 271. The meshing of the first primary output gear 267 with the second primary output gear 271 automatically provides the synchronization between the two motors. However, although not shown, the chains may be driven independently, without meshing the drive gears to provide synchronization. When driving each chain independently of the other, the two chains are effectively synchronized by each gripping to tubing passing between the chains. In this event, since the two primary drive output gears need not be meshed, the single gear box 231' can actually be two separate gear boxes. The addition of a second hydraulic motor on a side of the drive chains 211 and 213 opposite the first drive motor 253 does not increase the depth or profile of the injector 201' as compared with injector 201 shown in FIGS. 2–6. The gear box can be further adapted, in a manner similar to adapting gear box 231 to create gear box 231', to accommodate yet additional gear trains, rotary power inputs and motors. These rotary power inputs and motors would be located on the same side of the gear box as motors 253 and 278. For example, in FIG. 8, two additional motors could be accommodated below motors 253 and 278, respectively. Adding these additional motors may increase the width of the gear box in the directions indicated by arrows 291, but would not increase the depth of the injector in the directions indicated by arrows 278*a* and 278*b* in FIG. 6.

The forgoing embodiments are but examples of the invention. Modifications, omissions and rearrangement may be made to the forgoing embodiments without departing from the invention as defined by the appended claims.

What is claimed is:

1. A coiled tubing injector comprising:

a pair of continuous drive chains having opposed, elongated parallel runs spaced apart to form a path for engaging tubing passing therebetween, each drive chain mounted on a separate one of two sprockets, each of the two sprockets rotating about an axis parallel with the axis of the other of the two sprockets and both of the sprockets rotating generally within a common plane;

a plurality of grippers disposed on each drive chain;

reduction gear box having at least one rotary drive input and at least one rotary drive output, the gear box having a front side facing the drive chains and a back side facing away from the chains, the drive input and the drive output being both located on the front side of the gear box; and a motor coupled to the drive input;

wherein the drive output is coupled to one of the sprockets, the drive input is located outboard of the drive chains, and the motor extends from the front side of the gear box, through the common plane, outboard of the pair of drive chains.

2. The coiled tubing injector of claim 1 wherein the gear box includes a gear train extending laterally, generally in a second plane that is parallel to the common plane, from the drive input to the drive output for transmitting power.

3. The coiled tubing injector of claim 1 wherein the gear box includes a second rotary drive output located on the front side of gear box for delivery of rotational power to the other of the two sprockets.

4. The coiled tubing injector of claim 3 wherein the gear box includes a gear train for transferring power from the drive input to each of the first and second drive outputs.

5. The coiled tubing injector of claim 1 wherein the gear box further includes:

a second rotary drive input located on the front side of the gear box, outboard of the pair of drive chains; and a second motor coupled to the second drive input, the second motor extending from the front side of the gear box, through the common plane, outboard of the pair of drive chains.

6. The coiled tubing injector of claim 5 wherein, the gear box includes a second rotary drive output coupled to the other of the sprockets; and the gear box includes gear train means for transferring power from the first and second drive inputs to each of the first and second drive outputs, and the first and second drive outputs being coupled by intermeshed drive gears for synchronous rotation and transmission of power.

7. The coiled tubing injector of claim 6 wherein the first drive input drives only the first drive output and the second drive input drives only the second drive output, the first and second drive outputs thereby being driven independently of each other.

8. The coiled tubing injector of claim 6 wherein the first and second drive outputs are coupled for synchronous operation.

9. The coiled tubing injector of claim 5 wherein the second drive input and second motor are located on a side of the pair of drive chains opposite the first drive input and first motor.

10. A coiled tubing injector comprising:

a pair of continuous drive chains having opposed, elongated parallel runs spaced apart to form a path for engaging tubing passing therebetween;

a plurality of grippers disposed on each of the drive chains;

two sprockets, each drive chain mounted on a separate one of the two sprockets, each sprocket rotating about an axis parallel with the axis of the other of the two sprockets and both of the sprockets rotating generally within a common plane; and an elongated reduction gear box having a front side facing the drive chains and a back side facing away from the drive chains, the reduction gear box further including a rotary drive input and a first and a second rotary drive output, the drive input and the first and second drive outputs located on the front side of the gear box, each of the first and the second drive outputs being connected, respectively, to first and second output drive gears disposed within the gear box, the reduction gear box including a gear train for coupling the drive input to the first output drive gear, the first and second output drive gears being intermeshed for synchronous rotation and transmission of power from the first output drive gear to the second output drive gear.

11. The coiled tubing injector of claim 10 further comprising a motor coupled to the drive input, the drive input being located outboard of the pair of drive chains, whereby the motor extends from the front side of the reduction gear box through the common plane, outboard of the pair of drive chains.

12. The coiled tubing injector of claim 10 wherein the reduction gear box further includes a second rotary drive input for driving a second gear train, the second gear train being coupled to the second output drive gear.

13. The coiled tubing injector of claim 12 further comprising a first motor coupled to the first drive input, the first drive input being located outboard of the pair of drive chains, and a second motor coupled to the second drive input, the second drive input being located outboard of the pair of drive chains, whereby the first and second motors each extend through the common plane, outboard of the pair of drive chains.

14. The coiled tubing injector of claim 13 wherein the first drive input and first motor are on an opposite side of the pair of drive chains from the second drive input and second motor.

15. A coiled tubing injector comprising:

a pair of continuous drive chains having opposed, elongated parallel runs spaced apart to form a path for engaging tubing passing therebetween;

a plurality of grippers disposed on each of the drive chains;

two sprockets, each drive chain mounted on a separate one of the two sprockets, each sprocket rotating about an axis parallel with the axis of the other of the two sprockets and both of the sprockets rotating generally within a common plane; and a transmission including a first and a second rotary drive input and a first and a second rotary drive output, the first and second drive inputs and the first and second drive outputs facing the same direction, each of the first and the second drive outputs being connected, respectively, to first and second output drive gears, the transmission including a first gear train for coupling the first drive input to the first output drive gear, and a second gear train for coupling the second drive input to the second output drive gear.

16. The coiled tubing injector of claim 15 further comprising a first motor coupled to the first drive input, the first drive input being located outboard of the pair of drive chains, and a second motor coupled to the second drive input, the second drive input being located outboard of the pair of drive chains, whereby the first and second motors each extend through the common plane, outboard of the pair of drive chains.

17. The coiled tubing injector of claim 16 wherein the first drive input and first motor are located on an opposite side of the pair of drive chains from the second drive input and second motor.

* * * * *